US005488911A

United States Patent [19]

Riggin

[11] Patent Number: 5,488,911

[45] Date of Patent: Feb. 6, 1996

[54] COMPACTABLE SELF-EJECTING REFUSE CAR

[76] Inventor: Loren E. Riggin, P.O. Box 549, Terrell, Tex. 75160

[21] Appl. No.: 337,677

[22] Filed: Nov. 10, 1994

[51] Int. Cl.[6] ..... B61D 3/00

[52] U.S. Cl. ..... 105/240; 105/254; 105/258; 105/280; 105/286; 105/308.2; 105/377.1; 105/377.11; 105/377.08; 105/377.06

[58] Field of Search ..... 105/239, 240, 105/254, 256, 257, 276, 279, 286, 308.1, 308.2, 311, 258, 280, 377.1, 377.11, 377.08, 377.06; 298/13, 11, 18, 23 R, 23 C; 414/373, 398, 400

[56] References Cited

U.S. PATENT DOCUMENTS

| | | | |
|---|---|---|---|
| 547,095 | 10/1895 | Sutcliffe et al. . | |
| 730,886 | 6/1903 | Domingue . | |
| 4,010,695 | 3/1977 | Mantione | 105/254 |
| 4,016,991 | 4/1977 | Oldford | 214/386 |
| 4,104,130 | 8/1978 | Calderon | 105/254 |
| 4,235,169 | 11/1980 | Peterson | 105/251 |
| 4,312,712 | 1/1982 | Kwasnik et al. | 105/257 |
| 4,352,624 | 10/1982 | Matsumoto | 414/400 |
| 4,366,029 | 12/1982 | Bixby et al. | 105/254 |
| 4,923,356 | 5/1990 | Foster | 414/373 |
| 4,990,048 | 2/1991 | Foster | 414/398 |
| 5,044,870 | 9/1991 | Foster | 414/786 |

FOREIGN PATENT DOCUMENTS

| | | | |
|---|---|---|---|
| 0523623 | 11/1953 | Belgium | 105/254 |
| 0066127 | 5/1956 | France | 105/258 |
| 0869471 | 7/1949 | Germany | 105/258 |
| 0134390 | 1/1952 | Switzerland | 105/254 |
| 2057992 | 4/1981 | United Kingdom | 105/254 |

*Primary Examiner*—Mark T. Le
*Attorney, Agent, or Firm*—Charles C. Garner

[57] ABSTRACT

A structurally reinforced railroad car is provided which interfaces with the output of a typical refuse compactor and is capable of being thus forcibly filled with compacted refuse which efficiently fills and conforms to the interior, making maximum volumetric use of the car for efficient transportation to a disposal site. At the disposal site, hydraulic cylinders of the car cause the lid assembly of the car to pivot upwardly, leaving one side and top open, while a powered ejection panel from within the car pushes the refuse toward the open side until it falls over the edge. The car is equipped with engagable seals for containment of leachant and liquids which may form or be present in the refuse.

20 Claims, 4 Drawing Sheets

COMPACTABLE SELF-EJECTING REFUSE CAR

TECHNICAL FIELD

This invention relates to transport vehicles such as railroad cars, highway trucks, trailers, semi-trailers and the like, for receiving and transporting compacted refuse and similar bulk materials, having capability for self-unloading at remote sites.

BACKGROUND OF INVENTION AND STATEMENT OF NEED

Mankind continues to generate an ever expanding quantity of refuse which must be disposed of in an environmentally acceptable manner. This volume of unwanted bulk must be transported to environmentally approved disposal sites, such as land fills and injection wells for approved waste disposal. Environmentally approved disposal sites and wells are becoming scarce, and more and more are available only in remote and distant locales. The huge volume of refuse raises an ever increasing need for efficient transport means to such locales.

Means for transport to distances, through cities and sensitive locations, must be approvably sealed, and preferably should be capable of self unloading at remote sites, where support equipment may not be available for unloading. Means are known for compacting refuse; but the need remains for efficient means to load, transport, and unload large bulk volumes of compacted refuse at remote sites.

SUMMARY OF THE INVENTION

A structurally reinforced railroad car is provided which interfaces with a typical refuse compactor, wherein refuse is extruded into said car, forming a compacted refuse loaf which efficiently conforms to the interior of the car, thus providing for efficient transportation with maximum volumetric use of the car.

When the loaded car arrives at the dump site, hydraulic cylinders of the car cause one sidewall and the top wall, acting as a unit, to arc outwardly and upwardly, thus opening one entire side and the top of the car for unloading, while a powered ejector panel from within the car first breaks the refuse loaf loose from adherence to the inside of the car, and then pushes the refuse loaf down the sloped floor of the car toward the open side, past the center of the car, until, by a combination of rolling and sliding, the loaf moves over the open edge, falls from the car, and is unloaded due to its own weight.

The car is equipped with engagable resilient, water-tight seals at openings and fittings so as to retain, and prevent leakage of, leachants and liquids which may be present or generated in said refuse.

BRIEF DESCRIPTION OF THE DRAWINGS

An understanding of the Invention can be had by referring to the accompanying drawings, in cooperation with the later following Detailed Description, wherein:

FIG. 3 shows a schematic end view, with endwall 22 cut away, in the closed and latched mode, fully loaded and ready for transport, and for unloading.

FIG. 4 shows a schematic end view, with endwall 22 cut away for illustration, in an early stage of opening.

FIG. 5 shows a schematic end view, with endwall 22 cut away for illustration, in a succeeding stage of partial opening.

FIG. 6 shows a schematic end view, with endwall 22 cut away for illustration, in final stage of opening.

FIG. 7*a* shows latch detent 72 in the unlatched position, FIG. 7*b* shows it in the partially actuated position, and FIG. 7*c* shows it in the latched position, showing said latch assembly 56 located on cross-section views of part of floor 6, at openable edge 12, in contact with contact structure 52 which contains seal material 54, being a portion of subwall 19, a component of lid assembly 32.

DETAILED DESCRIPTION

Figure 1:
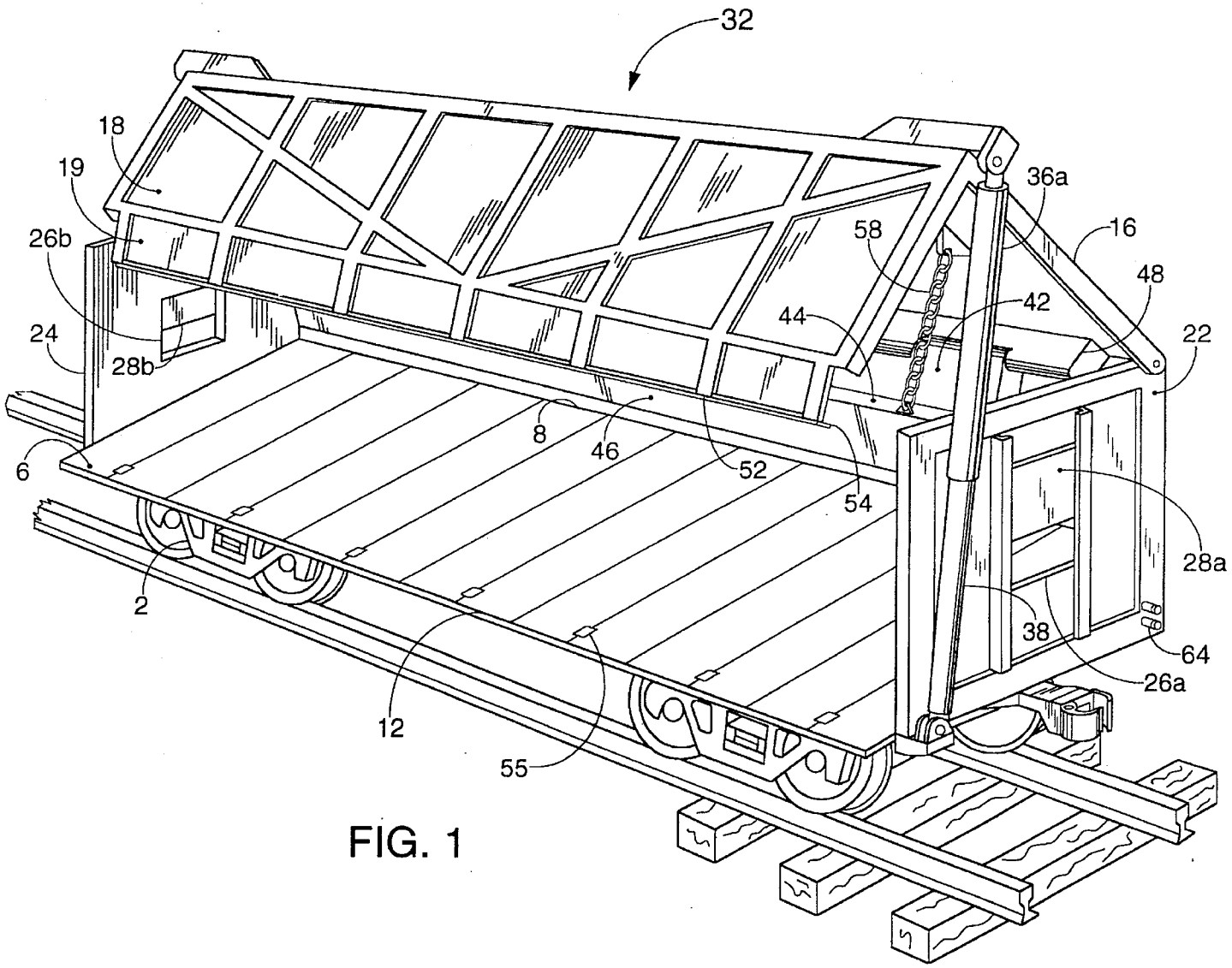
In FIG. 1, there is a perspective view of a compactable, self-ejecting railroad car 10 having the configuration of the preferred embodiment of this invention, in a typical geometry that would operate to accomplish a left hand opening self-unloading function of this invention.

To begin the detailed description, please refer to the details of the drawings, wherein like reference numerals designate like or corresponding parts throughout the several views. For illustration purposes, car 10 is shown in FIGS. 1–6 in a left hand opening configuration, in which the unloader openable edge 12 is located on the left hand side of the illustration, with the sidewall-lid assembly 32 pivoting upwardly and to the right. However, the disclosure of this invention can equivalently be a car configured to open on the other side of the car, with the sidewall-lid pivoting upwardly to the other direction, and in that case, the other views herein would correspondingly be arranged in a right hand unloader opening configuration.

The number and name of components on these drawings are listed as follows:

Components of "COMPACTABLE SELF-EJECTING REFUSE CAR":

| Number: | | Name: |
|---|---|---|
| 10 | - | vehicle |
| 02 | - | wheeled undercarriage |
| 04 | - | body |
| 06 | - | floor, inclined |
| 08 | - | edge, closed (of floor) |
| 12 | - | edge, openable (of floor) |
| 14 | - | sidewall, fixed |
| 16 | - | topwall |
| 18 | - | sidewall, upper-openable |
| 19 | - | subwall |
| 22 | - | endwall, first |
| 24 | - | endwall, second |
| 26a | - | door-opening (first endwall) |
| 26b | - | door-opening (second endwall) |
| 28a | - | door-panel (first endwall) |
| 28b | - | door-panel (second endwall) |
| 30 | - | loaf, compacted-refuse |

-continued

| Number: | | Name: |
|---|---|---|
| 32 | - | lid assembly |
| 34 | - | hinge, lid |
| 36a | - | cylinder, lid (first) |
| 36b | - | cylinder, lid (second) |
| 38a | - | rod, cylinder lid (first) |
| 38b | - | rod, cylinder lid (second) |
| 42 | - | panel, ejection |
| 44 | - | face, upwardly inclined (ejection panel) |
| 46 | - | face, downwardly inclined (ejection panel) |
| 48 | - | hinge, panel |
| 52 | - | structure, contact (bottom edge of subwall) |
| 54 | - | seal material, rubber (on bottom edge of subwall) |
| 55 | - | slots, seal-latch |
| 56 | - | latch assembly, (seal-latching) |
| 58 | - | chain, limit (ejection panel) |
| 62 | - | chocks, panel-return |
| 64 | - | disconnects, hydraulic |
| 66 | - | accumulator, hydraulic |
| 68 | - | cylinder, latch-assembly |
| 72 | - | detent, latch-assembly |

FIG. 1 is a perspective view of a compactable, self-ejecting railroad car 10 having the configuration of the preferred embodiment, of this invention. The railway car vehicle 10 comprises a typical known wheeled undercarriage 2 on which is mounted a body 4. The body 4 comprises a laterally inclined floor 6 having a closed edge 8 and an openable edge 12. Body 4 further comprises a generally vertical fixed sidewall 14 which is fixedly attached to floor 6 at closed edge 8, a lid assembly 32 comprising a topwall 16 and an openable sidewall 18 which in turn comprises subwall 19. Body 4 further comprises a first endwall 22 with a door opening **26*a* and an openable and closeable door panel 28*a*, and a second endwall 24 with a door opening 26*b* and an openable and closeable door panel 28*b***.

Figure 2:
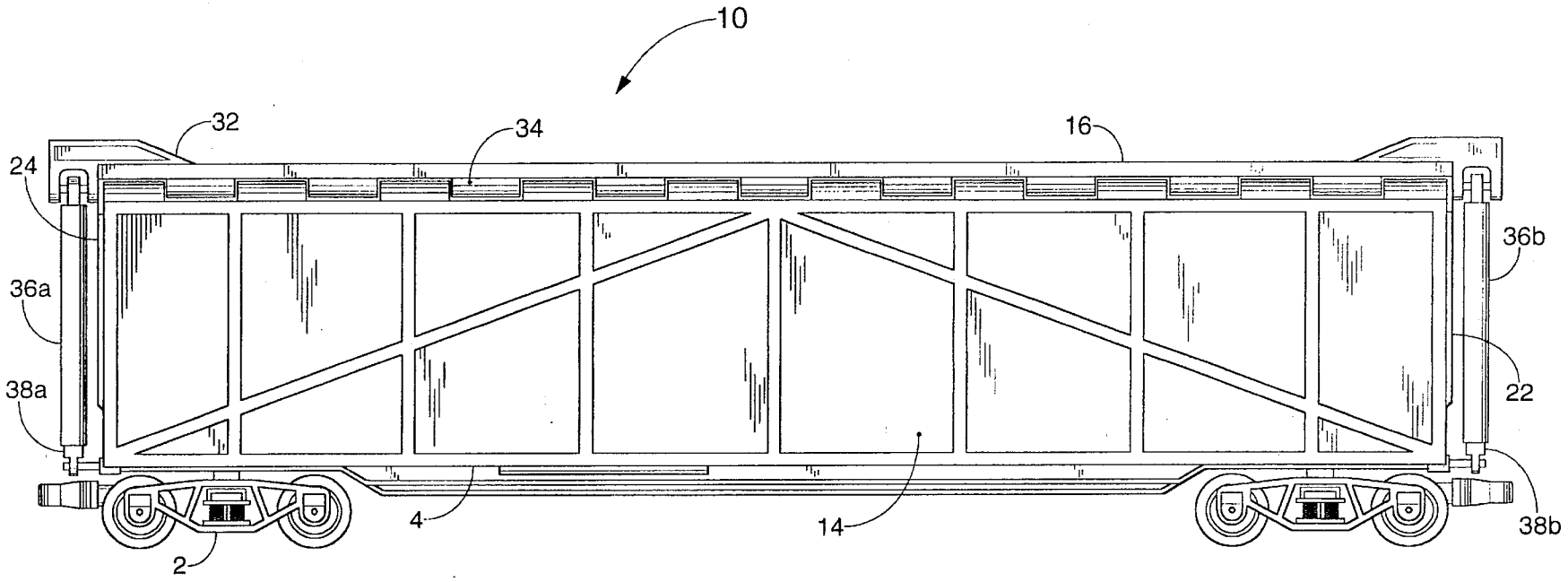
FIG. 2 shows a side view of car 10, from fixed sidewall 14 side.

Further, in FIG. 1, said lid assembly 32, is pivotally attached to the upper edge of fixed sidewall 14 by means of lid hinge 34 (as shown in FIG. 2), as means for pivotally permitting said lid assembly 32 to be opened by raising and pivoting it around lid-hinge 34. A pair of hydraulically actuatable lid cylinders **36*a* and 36*b* located one at each longitudinal end of car 10 (lid cylinder 36b, being not visible in FIG. 1), are each pivotally attached at its lower end to the lower part of body 4, and at its upper end to an upper corner of sidewall-lid assembly 32, in a manner which permits lid cylinders 36*a* and 36*b* (36*b* being hidden in FIG. 1) to be hydraulically extended, thus opening lid assembly 32 by pivoting upwardly about its lid-hinge 34**.

Figure 5:
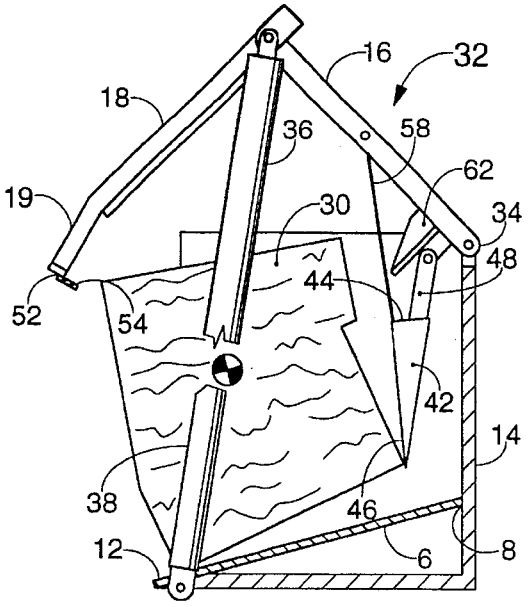
Figure 6:
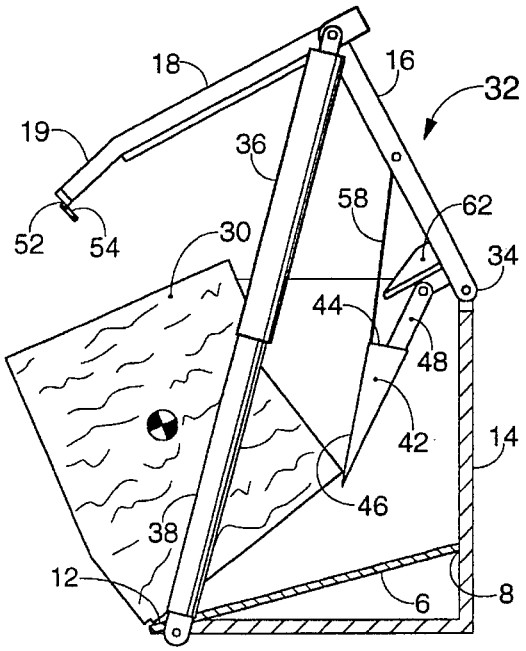
Figure 7A:
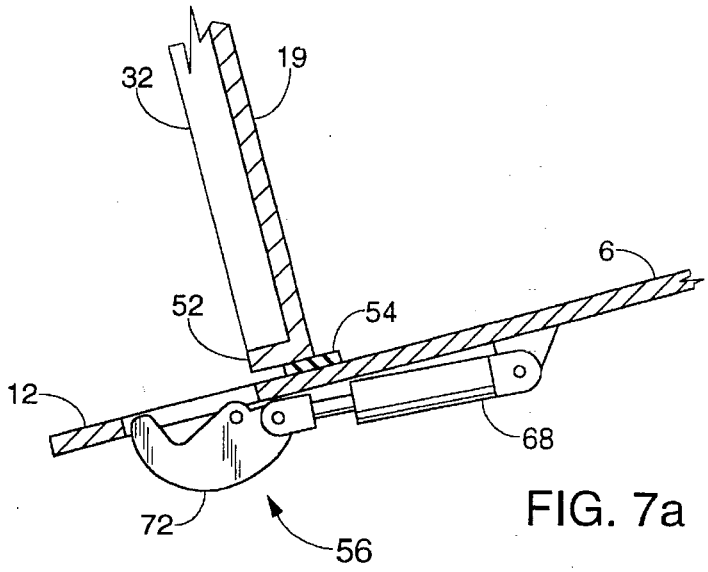
FIGS. 7*a–c* show operation of latch assembly 56 as it compresses contact structure 52 and seal material 54 against the surface of floor 6, as means for sealing body 04 for containing liquids in the closed position.
Figure 7B:
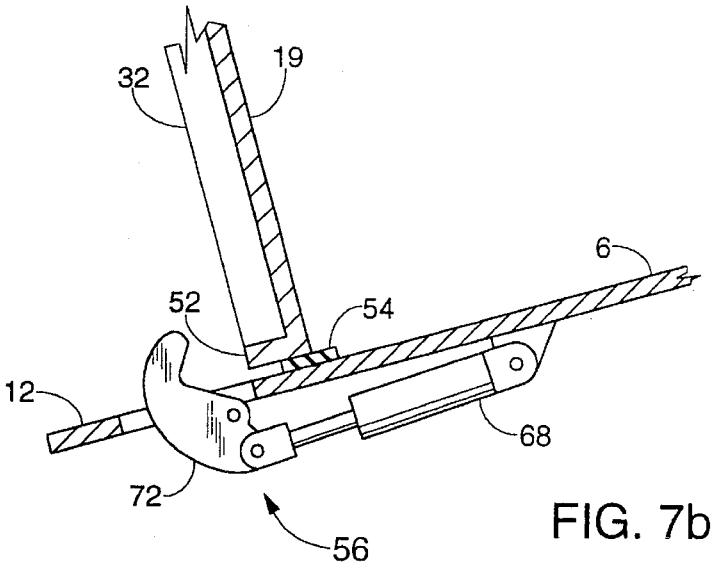
Figure 7C:
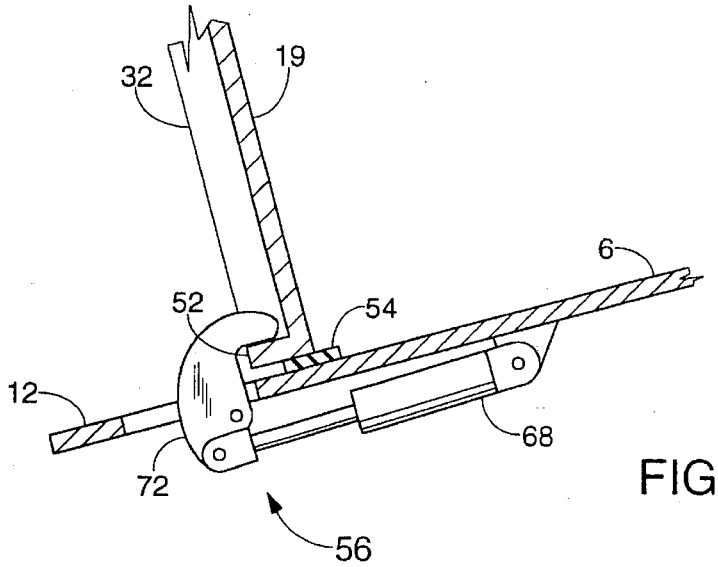

Further, FIG. 1 provides an inside view of empty car 10, without cargo, thus showing inclined floor 6, inclined at an angle which slopes downward toward openable edge 12 of floor 6, and likewise shows seal latch slots 55 arranged along lower edge 12, through which latch detents 72, not visible in this view but better shown in FIGS. **7*a*–7*c*, may be actuated upwardly by latch assembly 56, not visible in this view but shown in FIGS. 7*a*–7*c*, to latch with contact structure 52, thus forcing it to compress seal material 54 against the surface of floor 6, thus accomplishing a seal which contains liquids which may be present in compacted refuse loaf 30, as shown in FIGS. 3–6**.

Also in FIG. 1 may be seen the full-length ejector panel 42, which runs full length of interior of body 4, and which is pivotally suspended from topwall 16 by means of full length panel hinge 48. Ejector panel 42 is generally arranged to hang pivotally and substantially vertical, parallel and adjacent to fixed sidewall 14. Ejector panel 42 comprises an upwardly inclined face 44 and a downwardly inclined face 46. In FIG. 1, with lid assembly 32 being in the substantially open position, the openable sidewall 18 is in view, with its lower section, subwall 19, inclined inwardly at an angle which will be better illustrated in FIGS. 3–6. In FIG. 1, contact structure 52 is shown along the bottom edge of subwall 19, with contact structure 52 containing seal material 54 and being the structure which with seal material 54 is forced to contact floor 6, and which may be engaged and latched by latch detents 72 as shown in FIGS. **7*a*–7*c***.

Further, FIG. 1 shows limit chain 58, preferably comprised of non-tangle anchor chain, which is attached at its upper end to the underside of topwall 16, and at its lower end to the inward corner of ejection panel 42 at substantially the location where upwardly inclined face 44 joins downwardly inclined face 46. In FIG. 1, limit chain 58 is in tension, being raised upwardly by lid assembly 32 and thus applying upwardly rotating moment to ejection panel 42, causing ejection panel 42 to arc toward the openable side of car 10.

Further, FIG. 1 shows hydraulic disconnect 64 fittings located on body 4, through which outside hydraulic pressure source, not shown, may be connected and supplied to body 4 to provide operating pressure for lid cylinders **36*a* and 36*b*, and for hydraulic accumulator 66, which is not shown in this view but which is located on the main frame of car 10, and which supplies on-board source of constant hydraulic pressure for maintaining positive pressure and closure of latch assemblies 56 as better shown in FIGS. 7*a*–7*c***.

Further in FIG. 1 is seen one of the two hydraulic lid cylinders **36*a* and 36*b*, shown in the extended, opened, position which shows lid cylinder rod 38 in the extended position. In this preferred embodiment, lid cylinder(s) 36*a* and 36*b* are arranged and affixed in the downwardly facing position, in which lid cylinder 36 faces down in a manner better to be protected from loose and falling refuse and refuse liquids, thus tending to provide protection to said hydraulic components from damage and corrosion. Also, in this preferred embodiment, lid cylinder rod 38** will preferably be made of hollow tubing of adequate strength which will substantially reduce unnecessary weight.

In FIG. 1, please notice in this preferred embodiment, the structure of all components of body 4 are substantially reinforced and designed for at least three engineering purposes, i.e. (i) to withstand and contain the stresses encountered in industrial compaction, loading and containment of compacted refuse as extruded into this car and for which car 10 is intended; (ii) to perform self-ejecting unloading functions for which this car is intended; and (iii) to meet transportation, safety and structural requirements of U.S. Interstate Commerce Commission and regulatory agencies.

FIG. 2 is a side view of the railway car 10 from the fixed sidewall 14 side, showing wheeled undercarriage 2, body 4, fixed sidewall 14, and lid hinge 34, and in which the edge of topwall 16 and lid assembly 32 may be seen. FIGS. 2 also shows a side view of the two hydraulic lid cylinders **36*a* and 36*b*, one at each end of car 10, in the down and closed position, in which lid assembly 32 is closed and facing downwardly. Also partial side views of endwalls 22 and 24 are seen. Likewise, the preferred specially designed and reinforced structure, as described above, of fixed sidewall 14, lid hinge 32 and matching fittings and components of body 4**, may be seen.

FIGS. 3–6 show a series of schematic end view drawings of a typical configuration of one embodiment of this invention, with endwall 22 cut away for illustration, being the preferred embodiment, showing four sequential stages of operation, and positions, from the closed mode through two intermediate stages of opening, and to the fully extended open position. Further, FIGS. 3–6 show the containment, for which this car 10 is intended, of densely compressed refuse, forming a compacted refuse loaf 30, which has been forced to conform to and efficiently fill the interior of body 4, for optimum efficient use of cargo space. The compacted refuse loaf 30 is shown in sequential stages of being unloaded.

FIGS. 3–6 each show compacted refuse loaf 30, conforming to the interior of body 4. Body 4 is comprised of downwardly inclined floor 6 having closed edge 8 and openable edge 12, generally vertical fixed sidewall 14 fixedly attached to floor 6 at edge 8, sidewall-lid assembly 32 comprised of openable sidewall 18 fixedly attached to topwall 16 and cooperatively as a substantially rigid unit, pivotally attached to top of fixed sidewall 14 by means of lid hinge 34, and openable by means of lid cylinders 36*a* and 36 *b*. FIGS. 3–6 each show the location of seal latch assemblies 56 attached to underside of floor 6, said latches being actuatable through seal latch slots 55 (as seen in FIG. 1) and in a manner as illustrated in FIGS. *7a–7c*. FIGS. 3–6 also show ejector panel 42 pivotally suspended from the under side of topwall 16 by means of panel hinge 48. Panel 42 comprises upwardly inclined face 44 and downwardly inclined face 46. Panel 42 is generally suspended vertically along and substantially adjacent to fixed sidewall 14. Limit chain 58 is shown, preferably made of nontangle anchor chain, attached at its upper end to the underneath side of topwall 16 and at its lower end to the edge of upwardly inclined face 44.

In FIGS. 3–6, it will be seen that panel 42 is pivotally suspended by panel hinge 48 at a distance inboard from lid hinge 34 sufficiently to provide a rotatory moment arm about lid hinge 34 such that, as lid assembly 32 is pivoted upwardly by lid cylinders 36*a* and *b*, the initial movement of topwall 16 provides a substantially vertical lift to panel 42, upwardly for a distance of about six inches, in which upwardly inclined face 44 causes upward forces onto refuse loaf 30 sufficient to "break" it loose from adherence to sidewall 14 and floor 6. As lid assembly 32 is further pivoted upward, limit chain 58, which is attached further inboard along topwall 16 to form a larger moment arm as lid assembly is raised and which is loose when lid assembly is down and closed, is caused to at first tighten and then exert tension force upwardly onto the inside shoulder of panel 42, wherein panel 42 is forced to rotate inwardly about panel hinge 48, in an arc wherein panel 42 forces refuse loaf 30 to slide and-roll downwardly along inclined floor 6, falling over edge 12 and unloading of its own weight.

Figure 3:
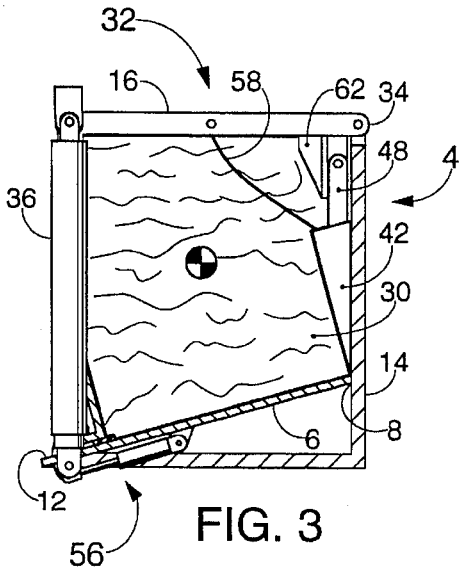
FIGS. 3–6 show a series of schematic end view drawings of a typical configuration of one embodiment, with endwall 22 cut away for illustration purposes, showing the loaded cargo, being a compacted refuse loaf 30, land showing four sequential stages of operation.

FIG. 3 shows car 10 in the closed down and latched mode, ready for transport and unloading.

Figure 4:
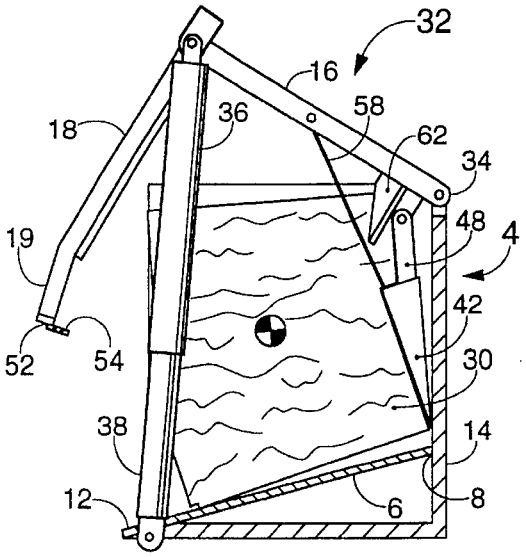

FIG. 4 shows car 10 in an early stage of opening, showing lid assembly 32 partially pivoted upwardly in an arc, wherein lid assembly 32 has been raised enough to lift ejection panel 42 vertically to break the refuse loaf loose from floor 6 and sidewall 14.

FIG. 5 shows car 10 in a succeeding stage of opening, showing lid assembly 32 further pivoted upwardly in an arc, wherein lid assembly 32 has been raised enough to cause limit chain 58 to tighten and cause ejection panel 42 to begin arcing inwardly, forcing refuse loaf 30 outward and partially down inclined floor 6.

FIG. 6 shows car 10 in final stage of opening, showing lid assembly 32 fully pivoted upwardly in an arc, wherein lid 32 is out of the way of lateral movement of refuse loaf 30 down floor 6 and over edge 12, wherein limit chain 58 is in tension, wherein ejection panel 42 has been arced inwardly, forcing refuse loaf 30 to slide and roll downward along floor 6, rolling and falling over edge 12, and being unloaded due to its own weight.

Other body shapes are equivalently covered in this invention disclosure. While, the preferred embodiment has been disclosed as a rectangularly shaped boxcar body, other body shapes can be equivalently used, within the scope, of this disclosure, with the same result. For example, an oval shape, or a semi-circular shape, or a triangular shape in which the walls slope upwardly to an apex, could be equivalently used. In any of the equivalent alternate body shapes, this invention would provide interface with the compactor; means for receiving and containing compacted refuse as it is extruded into the car body; and at the disposal site, means for opening one side and the top of the body sufficient to permit the compacted loaf contents to be broken loose and self-ejected laterally from the interior of the body; and means for self-unloading by self-ejection of the loaf from the body.

To assure disclosure, it is emphasized that FIG. 1 illustrates a structurally reinforced and especially designed, enclosed boxcar-type railroad car 10, capable of receiving and retaining compacted refuse 30 that is forcibly extruded into the interior of said car until said refuse fills said car and forms a loaf 30 which fills and conforms to the interior of said car 10, for transporting and self unloading of compacted refuse 30.

In this disclosure, "refuse" is defined to include industrial, commercial, and residential waste, city garbage, trash and refuse of all kinds, and the like. Preferably both ends, but at least one end, of the car is configured to interface with the output of a heavy duty, sometimes rail-mounted, refuse compactor, not shown in these drawings, of a type well known in the waste disposal industry, capable of compressing and compacting refuse, and extruding it into a dense, extrusion bar through the extrusion spout, into and through the interface with this rail car, and into the interior of the car. The shape of the extrusion bar may typically be approximately 4 ft.×4 ft. in cross-section as it is extruded and endless in length, but will be compacted and reshaped to conform to the interior of this car.

In the preferred embodiment, the car would have two hydraulic systems, being one system for the main hydraulic lid cylinders 36*a* and 36*b* for opening lid assembly 32; and another hydraulic system for seal latching cylinders 68 in accord with FIGS. *7a–7c*, for forcibly engaging and compressing-sealing materials 54 between contact structure 52 of subwall 19 against the surface of floor 6. Power is supplied by external hydraulic pressure available at the disposal site, supplied to the car via connection fittings 64. In the preferred embodiment, external hydraulic pressure will be available at all approved disposal sites. It would of course be equivalent to equip the car with electric motor and pump, and the like, for equivalent operation.

For self-ejection unloading at the disposal site, external hydraulic pressure, not shown in these drawings, is connected to the car's hydraulic system via disconnects 64. When activated, pressure first de-actuates latch cylinders 68, taking pressure off of seals 54, and preparing car 10 for opening. Then hydraulic pressure actuates main lid lift cylinders 36*a* and 36*b*, opening car 10 by pivoting lid assembly 32 upwardly about lid hinge 48. Pivoting of lid 32 into open position, causes ejection panel 10 to be first raised generally vertically, wherein face 44 breaks the compacted loaf 30 loose from adhering to the interior of car 10, and to be next pivoted and arced inwardly to push compacted loaf 30 downwardly along sloping floor 6 until, by a combination of rolling and sliding, it moves over side 12 and falls from car 10.

After unloading, the weight of lid assembly 32 and hydraulic pressure of lid cylinders 36*a* and 36*b*, pivot lid 32 downwardly to the closed position, wherein panel return chocks 62 simultaneously push ejection panel 42 back into position along sidewall 14. When lid 32 is closed, hydraulic pressure is exerted on seals 54 latch cylinders 68 as shown in FIGS. *7a–7c*, which closes seals 54, and in the preferred embodiment, the external hydraulic pressure system is used to re-charge onboard hydraulic accumulator 66, which is located on main frame of car 10. Pressure from accumulator 66 is continually applied directly to seal latch cylinders 68 for maintaining continuing pressure on seal latch cylinders 68, keeping car 10 sealed from liquid leaks at all times while loaded. External hydraulic pressure is then disconnected from the car, and the car is ready to return to the loading site, and is ready for loading and repeating the foregoing cycle.

EJECTION PANEL 42. The inside of topwall 16 is rotatably fitted with vertically raisable ejection panel 42, running the length of the car 10, by a panel hinge 48, running the length of the car. Ejection panel 42 has face 44 at an upwardly facing angle. The surface of face 44 is generally parallel to inclined floor 6 of car 10, as shown in FIGS. 1 and 3–6. Ejection panel 42 also has face 46 at a downwardly facing angle. The surface of face 46 is generally perpendicular to inclined floor 6 of car 10, as shown in FIGS. 1 and 3–6.

Vertically raisable ejection panel 42 is pivotally attached to the underneath side of topwall 14, i.e. lid 32, by panel hinge 48 at a pivot point located laterally a moment-arm distance of about eighteen inches from lid hinge 34, as shown in FIGS. 3–6. Said moment-arm distance needs to be great enough to provide sufficient moment arm, during the first approximately 15 degrees of arc as lid 32 begins to open, to raise the ejection panel vertically enough to cause face 44 to break loaf 30 loose from adhering to floor 6 and sidewall 14. That vertical distance for raising ejection panel 42 should be about six inches, more or less; and thus for a rail car 10 that is about ten feet wide, proportionally the moment-arm distance for panel hinge 48 pivot point for ejection panel 42 should be about sixteen to eighteen inches, more or less, inboard laterally, horizontally, from pivot point of lid hinge 34. Thus, as lid 32 is pivoted upward in an arc, the arc pivotally raises ejection panel 42 vertically a distance of about six inches, more or less. This vertical action causes face 44, as it is raised upwardly, to break the refuse loaf 30 free from floor 6 and from inside of fixed sidewall 14, as shown in FIGS. 3–6.

Vertically raisable ejection panel 42 is further connected to lid 32 by a non-tangle anchor chain, limit chain 58, the lower end of which is attached to the shoulder of face 44, and the upper end of which is attached to the inside of lid 32 at a point located laterally about forty percent of the horizontal width of the car from pivot point of lid hinge 34. This lateral distance inward for attachment of chain 58 must be great enough to provide moment arm about lid hinge 34 to raise chain 58 far enough as lid 32 is arced upward to the full open position, to cause chain 58 to tighten and force ejection panel 42 to arc inwardly far enough to push compacted loaf 30 well down floor 6 past center of the car 10. Thus, chain 58 first begins to tighten, and when tight, lifts and arcs ejection panel 42 upwardly and inwardly, forcing ejection panel 42 to pivot toward the unloading edge 12, causing face 46 to pivot and force refuse loaf 30 to roll and slide down sloped floor 6, as shown is FIGS. 3–6, wherein refuse loaf 30 rolls toward and falls over open edge 12, and is ejected and unloaded due to its own mass and pull of gravity.

The under side of lid assembly 32 is fitted with fixedly attached panel return chocks 62. When lid assembly 32 is lowered, chocks 62 arc downwardly with lid 32, forcibly pushing pivotable ejection panel 42 fully back into its generally vertical position against the inside of sidewall 14. Thus, ejection panel 42 is returned to position and inside of car 10 is configured for loading.

Car 10 is equipped with resilient seal materials 54 along contact structure 52, seal latch detents 72, and seal latch actuating cylinders 68; and pressure from onboard hydraulic accumulator 66 for sealably closing interior of car 10 seal surfaces 54, for leakproof containment of liquids and leachants from refuse loaf 30 while in transportation and storage.

SUBWALL. In this preferred embodiment, for efficient operation, the lower part of openable sidewall 18 is angled inwardly as shown in FIGS. 3–6, so as to be generally perpendicular to sloped surface of downwardly sloping floor 6. This perpendicular angle, presenting a square surface with floor 6, permits better surface interface for sealing lid assembly 32 to floor 6; and also, the inward angle of subwall 19 imparts a beveled contour to lower corner of refuse loaf 30, at the lower unloading side, providing a generally rounded or beveled edge which encourages loaf 30 to roll down sloped floor 6 of its own weight and fall outside of car 10.

OVERLAP OF SIDEWALL and LID ASSEMBLY ABOUT ENDWALLS. In this preferred embodiment, as shown in FIG. 1, lid assembly 32 generally and substantially overlaps and wraps around top and side edges of endwalls 22 and 24, thus further enhancing structure and ability to contain and withstand stresses of compaction and transportation for containment of compressed, compacted refuse loaf 30. The structure of lid assembly 32 overlaps and wraps around the side edges and topedges of endwalls 22 and 24, for added rigidity.

LEACHANT. As used in this disclosure, the term "leachant" is defined to be unwanted liquids which leach, percolate, condense or otherwise form, chemically, thermally and otherwise, within the waste constituents and refuse solids of compacted refuse loaf 30 during compaction, handling and transport of the load. These liquids are generally corrosive and environmentally undesirable, leakage of which is generally prohibited by environmental officials, and must be sealably contained within car 10 during handling and transport.

COMPACTION-INTERFACE DOOR. Car 10 is equipped with typical operable compaction door panels **28*a* and 28*b* which may be of the sliding type and equivalently may be hinged, for opening and closing each of interface door openings 26*a* and 26*b*** before and after compaction loading operations.

It is an aspect of this invention to provide interface with the compactor; means for receiving and containing compacted refuse as a compacted refuse loaf as it is forcefully extruded into the car body; at the disposal site, means for opening one side and the top of the body as a unit sufficient to permit the compacted loaf contents to be broken loose and laterally self-ejected from the interior of the body; means for self-unloading by laterally self-ejection of the loaf over the open edge of the body; and means for sealing the body for containment, and to prevent leakage, of liquids which may form or be present in the body.

EQUIVALENT TRANSPORT VEHICLES INCLUDED

For explanation, this invention has been described, discussed, and illustrated in the preferred embodiment as a railroad car. But this design is equally useful and efficient in other transport vehicles such as trucks, trailers, semi-tractors and the like, for over the highway utility and transport as well as rail. It is an aspect and embodiment of this present invention and disclosure that this concept and invention will be equivalently applicable as a highway truck, trailer, semi-trailer, and the like, as well as railroad car, for receiving refuse, for efficient transport over interstate highways, as well as local roads and intrastate highways, to appropriate disposal sites, and for self-ejection unloading at disposal sites, and other equivalent embodiments.

EQUIVALENT EMBODIMENTS INCLUDED

While only the preferred and some typical embodiments of this invention, have been illustrated in the accompanying drawings, and described in the Detailed Description, it will be understood that the invention is not limited to the embodiments disclosed, but is equally capable of numerous other equivalent arrangements, rearrangements, modifications and substitutions of parts and elements, equivalently to achieve the functions, means, way and results disclosed herein, without departing from the spirit and teaching of the invention, and are embodied in this invention.

What I claim is:

1. A compactable, self-ejecting transport vehicle for receiving, transporting and self-unloading refuse, comprising:

a wheeled undercarriage;

a body mounted on said undercarriage;

said body comprising:

means for receiving and containing refuse compacted to generally fill the interior of said body, comprising;

a laterally inclined floor having a closed edge and an openable edge;

a fixed sidewall attached to said floor at said closed edge;

said floor sloping laterally downward from said fixed sidewall to said openable edge;

an openable lid assembly comprising a topwall attached to an openable sidewall;

said lid assembly movably attached to said body by longitudinal lid joint means;

first and second endwalls attached to said floor and to said fixed sidewall;

a door opening in said body for receiving said refuse, and a closeable door panel;

means for opening and closing said body, comprising means for opening by raising said lid assembly about said lid joint means, and means for closing by lowering said lid assembly in the opposite direction; and means for laterally ejecting said refuse away from said fixed sidewall and toward said openable edge.

2. A vehicle according to claim 1 further comprising means for sealing said body for containing liquids when said lid assembly is in a closed position.

3. A vehicle according to claim 2 wherein said means for sealing comprises:

a contact structure on said lid assembly comprising sealing material which contacts said floor when in said closed position;

means for sealably engaging said sealing material with said floor in said closed position.

4. A vehicle according to claim 3 wherein said means for sealably engaging comprises:

means for compressing said sealing material between said contact structure and said floor for containment of liquids.

5. A vehicle according to claim 3 wherein said means for sealably engaging comprises:

a latching mechanism attached to said body for compressing said sealing materials between said contact structure and said floor, comprising a latch actuation mechanism and a latch engagable with said contact structure.

6. A vehicle according to claim 3 wherein said lid assembly further comprises a subwall containing said contact structure and sealing materials, said subwall attached to said openable sidewall at an angle generally perpendicular to said inclined floor in said closed position, said subwall comprising means for imparting a beveled contour to the shape of said compacted refuse.

7. A vehicle according to claim 1 wherein said means for laterally ejecting comprises:

an ejector panel suspended from said body generally parallel and adjacent to said fixed sidewall when said lid assembly is in a closed position;

said panel comprising an ejection surface for applying lateral pressure to said refuse;

said body comprising means for moving said ejection surface laterally toward said openable edge as said lid assembly is raised into an open position.

8. A vehicle according to claim 7 wherein said means for laterally ejecting further comprises:

said ejection panel pivotally suspended from said body by panel joint means;

said lid assembly comprising means for imparting moment arm force to said panel for pivoting said ejection surface laterally toward said openable edge.

9. A vehicle according to claim 7 wherein said means for laterally ejecting further comprises means for breaking said refuse loose from adhering to said fixed sidewalls and floor, comprising:

said panel comprising a lifting surface generally parallel to said inclined floor for applying upward pressure to said refuse;

said body comprising means for raising said lifting surface upwardly for a distance at least one-twentieth of the laterally width of said inclined floor, as said lid assembly is raised from said closed position.

10. A vehicle according to claim 1 wherein said body further comprises structural reinforcement means for withstanding stresses from compacting, transporting and ejecting said refuse.

11. A vehicle according to claim 1 wherein said means for opening further comprises at least one extension mechanism attached to said floor and to said lid assembly, for moving said lid assembly from said closed position to said open position.

12. A vehicle according to claim 1 wherein said means for opening further comprises a pair of hydraulically actuated, extension cylinders attached to said floor and to said lid assembly and having sufficient length when actuated to move said lid assembly to said open position.

13. A vehicle according to claim 7 further comprising panel return means attached to said lid assembly for urging said panel to return to position generally adjacent to said fixed sidewall when said lid assembly is lowered into said closed position.

14. A vehicle according to claim 13 wherein said panel return means comprises panel return chocks attached at a location on said lid assembly which arcs downwardly and imparts moment arm force on said panel.

15. A compactable, self-ejecting transport vehicle for receiving, transporting and self-unloading refuse, comprising:

a wheeled undercarriage;

a body mounted on said undercarriage;

said body comprising:

means for receiving and containing refuse compacted to generally fill the interior of said body comprising: two sidewalls; two endwalls; a topwall; a floor having a laterally openable edge extending substantially the length of said body; said floor laterally inclined downwardly towards said openable edge; an openable lid assembly comprising at least one of said sidewalls attached to said topwall; said openable lid assembly movably attached to said body by longitudinal lid joint means; said openable lid assembly openable towards said openable edge; the length of said openable lid assembly extending substantially the length of said openable edge; and a door opening in said body for receiving said refuse;

means for opening and closing said body, comprising means for opening by raising said lid assembly about said lid joint means, and means for closing by lowering said lid assembly in the opposite direction; and means for laterally ejecting said refuse toward said openable edge.

16. A vehicle according to claim 15 further comprising means for sealing said body for containing liquids when said lid assembly is in a closed position.

17. A vehicle according to claim 15 wherein said means for laterally ejecting comprises:

an ejector panel suspended from said body generally parallel and adjacent to said sidewalls when said lid assembly is in a closed position, and extending substantially the length said openable edge;

said panel comprising an ejection surface for applying lateral pressure to said refuse;

said body comprising means for moving said ejection surface laterally toward said openable edge as said lid assembly is raised into an open position.

18. A vehicle according to claim 17 wherein said means for laterally ejecting further comprises means for breaking said refuse loose from adhering to said fixed sidewalls and floor, comprising:

said panel comprising a lifting surface generally parallel to said inclined floor for applying upward pressure to said refuse;

said body comprising means for raising said lifting surface upwardly for a distance at least one-twentieth of the laterally width of said inclined floor, as said lid assembly is raised from said closed position.

19. A vehicle according to claim 15 wherein said means for opening further comprises a pair of hydraulically actuated, extension cylinders attached to said floor and to said lid assembly and having sufficient length when actuated to raise said lid assembly to said open position.

20. A vehicle according to claim 17 further comprising panel return chocks attached at a location on said lid assembly which arcs downwardly with said lid assembly and imparts moment arm force on said panel.

* * * * *